US005987833A

United States Patent [19]

Heffelfinger et al.

[11] Patent Number: 5,987,833

[45] Date of Patent: Nov. 23, 1999

[54] VACUUM PACKAGED BATT

[75] Inventors: Michael T. Heffelfinger, Westerville; Roy E. Shaffer, Granville, both of Ohio

[73] Assignee: Owens Corning Fiberglas Technology, Inc., Summit, Ill.

[21] Appl. No.: 08/880,822

[22] Filed: Jun. 24, 1997

[51] Int. Cl.[6] ..... E04B 1/62; E04B 1/74; E04G 9/10

[52] U.S. Cl. ..... 52/406.2; 52/2.16; 52/2.19; 52/2.22; 52/407.3; 52/742.12; 428/69; 428/74; 428/76; 383/211

[58] Field of Search ..... 52/404.1, 406.1, 52/406.2, 406.3, 407.2, 407.3, 407.4, 407.5, 742.11, 742.15, 2.11, 2.13, 2.14, 2.16, 2.17, 2.19, 2.22, 2.25, 742.12, 741.4, 99, 404.3; 428/69, 74, 76; 383/2, 3, 206, 211, 210, 66; 206/321

[56] References Cited

U.S. PATENT DOCUMENTS

| | | | |
|---|---|---|---|
| 2,226,617 | 12/1940 | Kuenzli | 52/742.11 |
| 2,684,807 | 7/1954 | Gerrish | 383/206 |
| 3,307,318 | 3/1967 | Bauman | 52/742.11 |
| 3,782,081 | 1/1974 | Munters . | |
| 4,040,804 | 8/1977 | Harrison . | |
| 4,182,085 | 1/1980 | Elson | 52/406.3 X |
| 4,204,373 | 5/1980 | Davidson | 52/741.1 X |
| 4,269,890 | 5/1981 | Breitling et al. | 428/71 |
| 4,344,265 | 8/1982 | Davidson | 52/745.15 |
| 4,399,645 | 8/1983 | Murphy et al. | 52/406.2 X |
| 4,509,304 | 4/1985 | Epes | 52/406.2 X |
| 4,522,556 | 6/1985 | Shapiro | 414/786 |
| 4,594,279 | 6/1986 | Yoneno et al. . | |
| 4,668,551 | 5/1987 | Kawasaki et al. . | |
| 4,669,632 | 6/1987 | Kawasaki et al. . | |
| 4,675,225 | 6/1987 | Cutler | 428/74 X |
| 4,726,974 | 2/1988 | Nowobilski et al. . | |
| 4,749,392 | 6/1988 | Aoki et al. . | |
| 4,817,365 | 4/1989 | Yawberg et al. . | |
| 4,901,676 | 2/1990 | Nelson | 52/406.3 X |
| 4,985,106 | 1/1991 | Nelson | 156/276 |
| 5,018,328 | 5/1991 | Cur et al. . | |
| 5,114,003 | 5/1992 | Jackisch et al. . | |
| 5,130,018 | 7/1992 | Tolman et al. . | |
| 5,137,747 | 8/1992 | Malandain et al. . | |
| 5,152,018 | 10/1992 | Lea | 428/74 X |
| 5,196,242 | 3/1993 | Vicino | 428/12 |
| 5,277,955 | 1/1994 | Schelhorn et al. | 428/74 |
| 5,316,816 | 5/1994 | Sextl et al. . | |
| 5,330,816 | 7/1994 | Rusek, Jr. . | |
| 5,362,539 | 11/1994 | Hall et al. | 428/68 |
| 5,431,992 | 7/1995 | Houpt et al. . | |
| 5,458,164 | 10/1995 | Tawil | 141/10 |
| 5,466,504 | 11/1995 | Gavin et al. . | |
| 5,508,079 | 4/1996 | Grant et al. . | |
| 5,512,346 | 4/1996 | Johnson | 428/74 |
| 5,545,279 | 8/1996 | Hall et al. . | |
| 5,545,453 | 8/1996 | Grant | 52/406.1 X |
| 5,552,205 | 9/1996 | Lea | 428/74 |
| 5,591,505 | 1/1997 | Rusek, Jr. et al. . | |
| 5,601,897 | 2/1997 | Vermilion et al. . | |
| 5,817,387 | 10/1998 | Allwein et al. | 428/74 X |

FOREIGN PATENT DOCUMENTS

| | | | |
|---|---|---|---|
| 1313933 | 11/1962 | France | 52/407.3 |
| 2539784 | 7/1984 | France | 52/404.1 |
| 3402377 | 8/1985 | Germany | 52/406.1 |

*Primary Examiner*—Laura A. Callo
*Attorney, Agent, or Firm*—Inger H. Eckert; Stephen W. Barns

[57] ABSTRACT

A vacuum packaged conformable insulation assembly may be installed in a cavity before the vacuum in the insulation assembly is released. The insulation assembly includes a compressible batt of mineral fibers such as fibrous glass wool. During manufacture, the batt is encased in a gas-impervious envelope. The envelope is vacuum-sealed to retain the batt in a compressed state. The envelope may be provided with opening structures for selectively releasing the vacuum in the envelope. The envelope is sufficiently large to permit the batt contained therein to fully recover when the vacuum is released. According to a method of the present invention, the envelope is placed in a cavity to be insulated, and then the envelope is ruptured to allow the batt to expand to cause the insulation assembly to conform to the cavity.

5 Claims, 6 Drawing Sheets

VACUUM PACKAGED BATT

TECHNICAL FIELD AND INDUSTRIAL APPLICABILITY OF THE INVENTION

This invention relates to a vacuum packaged conformable insulation assembly which is used to insulate structures such as floors and walls and the like of buildings or machinery such as refrigerators and dishwashers, and to a method of installing such vacuum packaged conformable insulation assembly.

BACKGROUND OF THE INVENTION

It is well known in the art to insulate buildings and machinery such as refrigerators and dishwashers and other appliances using various types of insulating materials including mineral fibers such as fibrous glass wool. Such insulation acts as a thermal barrier to heat, and may also act as an acoustic insulation against the transmission of sound.

Prior art glass wool blankets are generally formed with a well-defined shape. They often include a binder, such as a phenolic resin, added to the glass wool subsequent to the fiberizing process. The resultant insulating material has sufficient strength and rigidity to be employed as insulating blankets in walls, floors and ceilings.

However, prior art glass wool blankets, due to their use of primarily short fibers, binders, and general inability to recover from a compressed state to a shape other than their well-defined uncompressed state have limited ability to conform to the insulation cavities of a building into which they are installed. That is, building construction inevitably contains abnormal voids, for example, spaces created between floor, wall, and ceiling joists, as a part of the framing construction or non-uniformly shaped barriers such as electrical wiring, boxes and plumbing. Existing insulation blankets, being generally composed of primarily short fibers and substantially well defined shape, are unable to stretch and conform to and fill these abnormal voids. As a result, the effectiveness of the insulation is diminished when gaps and abnormal voids are present. Alternatively, the installer must cut the insulation to fit into the voids, increasing the time required to do the project. These gaps also reduce the insulation's effectiveness.

A further problem is presented by the use of conventional mineral fiber insulation material is the binder material which must necessarily be added to the fibers to provide product structural integrity. Binder provides bonding at the fiber to fiber intersections in the insulation blanket lattice. However, binders are expensive and have several environmental drawbacks. As most binders include organic compounds, great pains must be taken to process effluent from the production process to ameliorate any possible negative environmental impact. Further, the binder must be cured with an oven using additional energy and creating additional environmental cleanup costs.

Non-wool insulation products, such as loose fill, are also known. These loose fill products are conformable in the sense that they have no preordained shape. Loose fill is merely individual groups or nodules of insulation fibers. The insulation is generally installed by blowing into the area to be insulated. However, the insulation is difficult to handle, requires special equipment to install and due to its installation technique and loose nature, loose fill insulation can leave gaps and voids when blown into the cavity. These gaps and voids may be difficult to detect, since the vertical surfaces of the cavity (i.e., the inner and outer surfaces of a building wall) must be necessarily installed prior to filling the cavity with the loose fill material. Further, in contrast to an insulation batt, loose fill insulation cannot be handled as a unit.

Recently, binderless wool insulation products have been developed. U.S. Pat. No. 5,277,955 to Schelhorn et al. discloses a binderless insulation assembly. The insulation assembly comprises a mineral fiber batt, such as glass fibers, enclosed within an exterior plastic covering. Binder is not required. Adhesive is used to hold the plastic cover to the fiber batt. The insulation assembly of Schelhorn et al. is substantially fully expanded (uncompressed) prior to being installed into the voids or insulation cavities in construction spaces. Thus an installer must carefully cut and tuck the insulating material about any obstructions in the cavity into which the insulation assembly of Schelhorn et al. is being installed, being careful that the insulating material fully fills the cavity, in a manner similar to conventional glass fiber batts having binders.

U.S. Pat. No. 5,508,079 to Grant et al. discloses another binderless insulation assembly. The insulation assembly comprises a mineral fiber batt, such as glass fibers, which are substantially long and preferably irregularly shaped. The batt may be enclosed within an exterior plastic covering. Binder is not required. A layer of adhesive or other means for restricting movement holds the plastic cover to the fiber batt, allowing the insulation assembly to be installed vertically in walls, for example. The insulation assembly of the Grant et al. patent is compressed for packaging and shipment. When removed from the packaging, the batt begins to recover (expand from the compressed state). The insulation assembly is then installed into a construction cavity, continuing recovery due to handling associated with installation. As the insulation assembly continues to recover, it conforms to the cavity within which the insulation assembly is installed.

Another form of insulation assembly is shown in U.S. Pat. No. 4,726,974 to Nowobilski et al. The insulation assembly is an vacuum-sealed insulation panel comprising a compressed fiberglass substrate. The insulation assembly relies on the vacuum of the bag to maintain the insulating properties of the insulation assembly, which may be used, for example in about cryogenic equipment as a heat insulation panel. The insulation assembly of the Nowobilski et al. reference does not expand to conform to a cavity in which it is installed. Accordingly, the insulation assembly of the Nowobilski et al. reference is inappropriate for use in such applications as insulating between the studs of a building wall which contains abnormal voids created by such obstructions as electrical and plumbing connections.

Another form of insulation assembly is shown in U.S. Pat. No. 4,669,632 to Kawasaki et al. The insulation assembly is an evacuated bag containing a heat insulation material such as glass fibers. The insulation assembly relies on the vacuum of the bag to maintain the insulating properties of the insulation assembly, which may be used, for example in refrigerators as a heat insulation panel. The insulation assembly of the Kawasaki et al. reference is flexible but, like the Nowobilski et al. reference, does not expand to conform to a cavity in which it is installed. Accordingly, the insulation assembly of the Kawasaki et al. reference is inappropriate for use in such applications as insulating between the studs of a building wall which contains abnormal voids created by such obstructions as electrical and plumbing connections.

The need remains for an insulation assembly which conforms to abnormal voids in building spaces, is relatively easy and quick to install to minimize installation time and labor costs, and does not have the drawbacks of loose fill insulation. The need also remains for a method for installing such an insulation assembly in a relatively easy and efficient manner.

SUMMARY OF THE INVENTION

The present invention is directed to a vacuum packaged conformable insulation assembly that may be installed in a cavity before the vacuum in the insulation assembly is released. The insulation assembly includes a compressible batt of mineral fibers such as fibrous glass wool. During manufacture, the batt is encased in a gas-impervious envelope. The envelope is vacuum-sealed to retain the batt in a compressed state. The envelope may be provided with opening structures for selectively releasing the vacuum in the envelope. The envelope is sufficiently large to permit the batt contained therein to fully recover when the vacuum is released. According to a method of the present invention, the envelope is placed in a cavity to be insulated, and then the envelope is ruptured to allow the batt to expand to cause the insulation assembly to conform to the cavity.

DETAILED DESCRIPTION AND PREFERRED EMBODIMENTS OF THE INVENTION

The description and drawings disclose packages of compressible fiberglass insulation. It is to be understood that the insulation material can be any compressible insulation material, such as rock wool, slag, wool, basalt or polymer fiber. More particularly, the present invention comprises a conformable insulation blanket and a conformable insulation assembly which is provided to the end user in a compressed state, where the compression of the insulation blanket or batt is maintained by a vacuum sealed into the outer envelope of the insulation assembly. The insulation is installed in a cavity with the envelope intact and the batt compressed by the external air pressure acting on the evacuated envelope. When the installer is ready, the envelope is ruptured, relieving the vacuum, and allowing the batt to expand and conform to abnormal voids and spaces caused by obstructions in the cavity into which the conformable insulation is installed. This ability to cause the insulation assembly to expand and conform at a time of the installer's choosing, i.e., after the insulation assembly is filly placed into the cavity is a significant advancement over the prior art.

As used herein, the term "vacuum" unless otherwise clearly stated should mean that the atmospheric pressure within the volume of interest, i.e., inside the envelope of the insulation assembly of the present invention, is lower than the pressure of the atmosphere surrounding the area of interest. Thus, it is assumed for the purposes of this disclosure that when a vacuum exists in the envelope of an insulation assembly of the present invention, a differential pressure exists which, acting over the surface of the envelope, produces compressive forces acting on the envelope and the contents thereof. Furthermore, the expressions "release a vacuum", "discharge a vacuum", or "relieve a vacuum" in the envelope of the insulation assembly of the present invention means to rupture the envelope to permit the surrounding atmosphere (or other source of gas) to enter the envelope to raise pressures inside the envelope to at least the pressure outside the envelope.

Additionally, the term "rupture" as used with respect to the envelope of this invention means to puncture, cut, tear, or otherwise create, open, uncover, or otherwise provide an opening through material of the envelope to break the hermetic seal thereof. The term rupture as used herein should be understood to include removing a layer of the envelope that seals a pre-existing hole through a second layer of the envelope. Such a removable layer of the envelope need not be coextensive with any other layer of the envelope, but could be, for example, a strip of tape adhesively fastened to cover a hole through another layer of the envelope.

Figure 1:
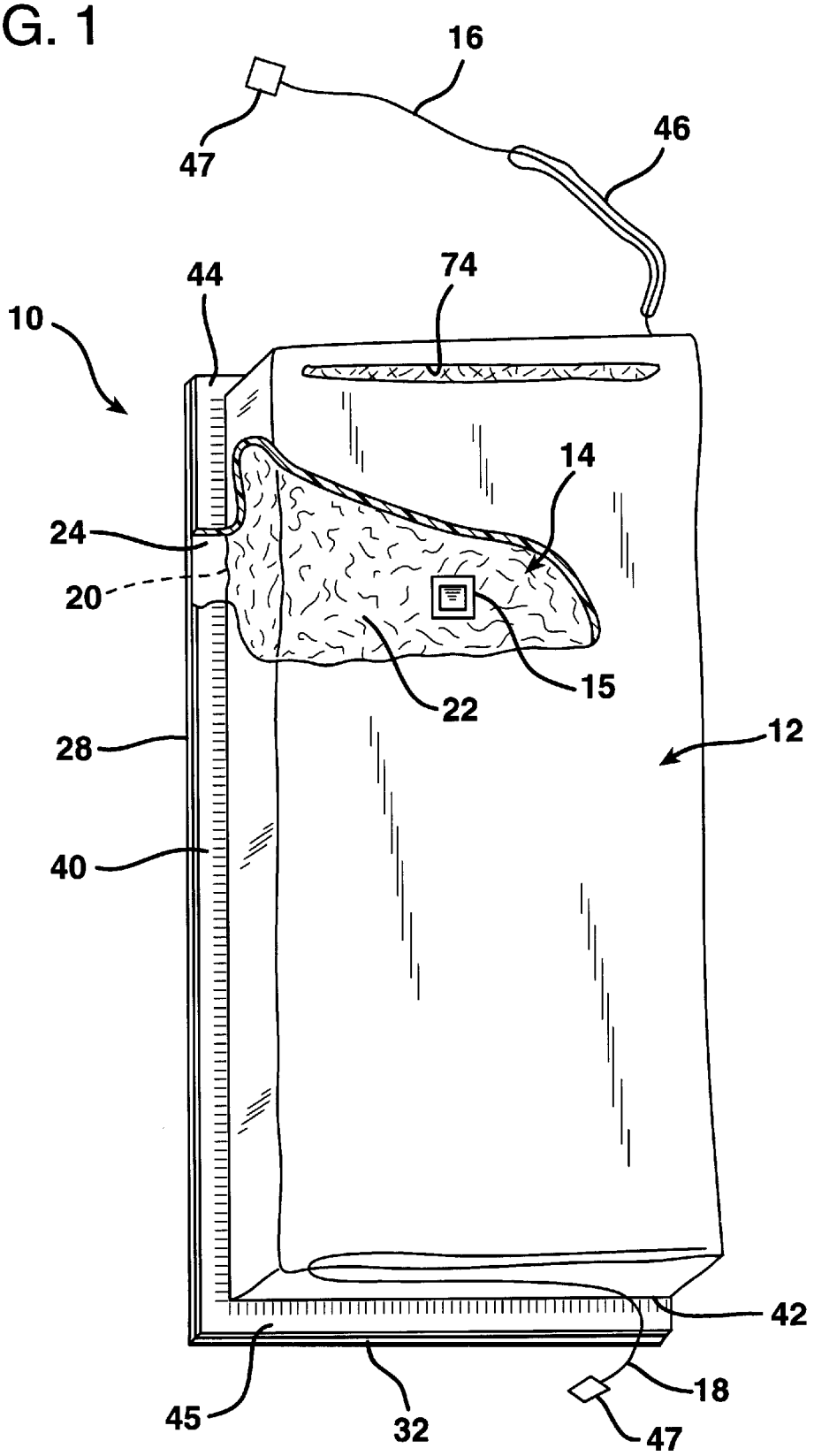
FIG. 1 is a perspective of an insulation assembly of the invention, partly broken away to show an insulation batt therein.

An insulation assembly of the present invention, indicated generally at 10, is illustrated in FIG. 1. The insulation assembly 10 is an embodiment of the invention especially adapted for fitting into the exterior wall cavities of a building. The view of FIG. 1 is that of a viewer outside a building looking through the exterior wall (not shown) to see the insulation assembly installed in a cavity in the wall. Thus the view of FIG. 1 shows the side of the insulation assembly 10 which faces away from the installer thereof when the insulation assembly 10 is installed from inside the building, as is normal.

The insulation assembly 10 includes an envelope 12 and an insulation batt 14 contained within the envelope 12. The envelope 12 is illustrated partially broken away to show the batt 14, and to show a desiccant packet 15 which may optionally be enclosed in the envelope as will be further described below. The insulation assembly 10 further includes a structure facilitating the controlled rupturing of the envelope 12, embodied in FIG. 1 as a first ripcord 16 and a second ripcord 18.

The batt 14 is preferably a binderless insulation batt similar to the mineral fiber batt disclosed in commonly assigned U.S. Pat. No. 5,508,079 to Grant et al., entitled CONFORMABLE INSULATION ASSEMBLY, the disclosure of which is herein incorporated by reference. Prior art insulation batts generally include a binder. The presence of the binder holds the prior art fibers into a compressible, but rigid predefined matrix. Fibers held by binder are incapable of movement beyond the pre-defined matrix. Thus, an insulation employing binderless mineral fibers will be capable of much greater movement than more rigid bindered fibers. As used in the present specification and claims, the term "binderless" means the absence of binder materials or the presence of only small amounts of such binder materials, amounting to no more than one percent (1%), by weight of the insulation product. Addition of lubricants or suppressants, e.g. oils, for lubrication of fiber-to-fiber contacts, dust control or other purposes is not considered a binder.

Preferably, the batt 14 has substantially long fibers. Traditional prior art insulation products employ short fibers due to entanglement problems that create an undesirable appearance and reduced insulating ability. The batt 14, on the other hand, preferably employs substantially long mineral fibers. The long fibers in the batt 14 are collected in such a way, as disclosed in U.S. Patent No. 5,508,079 to Grant et al., that they do not overly entangle to the extent that they can in some prior art processes. As a result, there are more individual fibers that can act independently in the insulation of the present invention.

As used herein, the phrase "the use of substantially long fibers" refers to the use of substantial proportion of long fibers, that is generally 20% or more by weight or number. Furthermore, for purposes of this patent specification, the term "short" fibers is intended to include fibers of approximately 2.54 centimeters (cm) (1 inch) in length and less, and the term "long" fibers is intended to include fibers longer than approximately 5.08 cm (2 inches), preferably 17.78 cm (7 inches) and more preferably 30.48 cm (12 inches).

The glass fibers employed with the batt 14 may be either conventional straight fibers or, preferably, bicomponent, irregularly-shaped glass fibers. Irregularly-shaped glass fibers and methods for producing and collecting them are disclosed in commonly assigned U.S. Pat. No. 5,431,992, to Houpt et al., entitled DUAL-GLASS FIBERS AND INSULATION PRODUCTS THEREFROM, the disclosure of which is herein incorporated by reference. The batt 14 of the present invention may be, for example, constructed of low density fibrous glass wool having an uncompressed density of less than about 0.6 pounds per cubic foot (pcf) (9.61 kg/m$^3$). Preferably, the batt 14 has an uncompressed density of between 0.30 pcf (4.81 kg/m3) and 0.50 pcf (8.01 kg/m3).

Returning to FIG. 1, for the purposes of illustration, the batt 14 is shown in an uncompressed, fully expanded condition. As will be explained below, the batt 14 will normally be allowed to expand only after the insulation assembly 10 is installed in a cavity to be insulated. The insulation assembly 10 and the batt 14 are illustrated in a vertical orientation as if installed in a wall cavity, with the first ripcord 16 positioned in an upper part of the envelope 12. As most clearly shown in FIGS. 1 and 3C, the batt 14 includes a front surface 20 and an opposed back surface 22. As the batt 14 of the present invention preferably lacks a binder, some degree of product integrity is surrendered. However, due to the nature of the long fibers preferably used to constitute the batt 14, the fibers of the batt 14 are sufficiently interlocked that the batt 14 does not readily disintegrate. Rather, the batt 14 of the present invention remains an integral product with generally uniform weight distribution throughout, even when oriented vertically as shown in FIG. 1.

As disclosed in U.S. Pat. No. 5,466,505 to Gavin et al., entitled FIBROUS GLASS INSULATION ASSEMBLY, the disclosure of which is herein incorporated by reference, the use of a desiccant with an encapsulated fibrous glass insulation batt can improve recovery of the glass batt from a compressed state by preventing the batt from absorbing moisture. It is anticipated that because the insulation assembly 10 of the present invention is vacuum packaged, there will normally be little residual moisture inside the envelope available to be absorbed into the fibrous glass body of the batt 14. Thus desiccant may not normally be required to be included in the envelope 12 with the batt 14. However, under certain circumstances, such as when it is known that the insulation assembly 10 will be stored for a length of time, it may be desirable to include a desiccant with the batt 14. The desiccant packet 15 may suitably be enclosed in the envelope 12 for the purpose of absorbing moisture enclosed in the envelope 12. As further described in the Gavin et al. reference, the desiccant thus included may be contained within a moisture permeable desiccant package like the desiccant packet 15, may be included in a plurality of such packages dispersed about the batt 14, or may not be contained in a package at all, but rather may be applied directly to the batt 14, such as by spraying a layer of desiccant onto the batt 14.

In the embodiment of the invention illustrated in FIG. 1, the envelope 12 is formed from two separate sheets of material joined to completely enclose the batt 14. A first sheet of material forming the envelope 12 is the vapor barrier 24, which is most clearly seen in FIGS. 2 through 3C. The vapor barrier 24 contacts the front surface 20 of the batt 14, but extends beyond the front surface 20 in all directions to form a pair of vertically extending flaps 26 and 28 and a pair of horizontally extending flaps 30 and 32 which are not in contact with the batt 14. As may be seen in FIG. 2, one purpose of the flaps 26, 28, 30, and 32 (not shown in FIG. 2) is to act as nailing strips for attaching the vapor barrier 24 to a building wall or other structural member. The vertically extending flaps 26 and 28 may be attached by nail 33 or staples to adjacent studs 34, while the horizontally extending flaps 30 and 32 may be nailed or stapled to the header 36 and footer (not shown) of the wall.

The second sheet forming the envelope 12 is the back sheet 38. The back sheet 38 contacts the back surface 22 of the batt 14, wraps around the sides, top, and bottom of the batt 14 (as viewed in FIG. 1), and forms a pair of vertically extending flaps 40 and 42, and a pair of horizontally extending flaps 44 and 45. The vertically extending flaps 40 and 42 are preferably contacting and coextensive with the vertically extending flaps 26 and 28, respectively, of the vapor barrier 24. Similarly, the horizontally extending flaps 44 and 45 are preferably contacting and coextensive with the horizontally extending flaps 30 and 32, respectively, of the vapor barrier 24.

The vapor barrier 24 and the back sheet 38 of the envelope 12 may be constructed from any suitable barrier material. For example, it is believed that suitable envelopes could be formed of plastics such as polyethylene, polybutylene, or polyester, or a composite polymer which could, for example be co-extruded, tri-extruded, or coated with barrier film or a metalicized films, or other suitable flexible materials such as polymer lined kraft paper. In the preferred insulation assembly 10, the vapor barrier 24 and the back sheet 38 are formed from polyethylene film. The film forming the back sheet 38 preferably has a thickness of about 1.0 mil (1/1000 inch) (0.025 millimeters (mm)) or less, more preferably, 0.2 mil to 0.6 mil (0.005 mm to 0.015 mm), with one preferred thickness being 0.4 mil (0.010 mm).

The vapor barrier 24 may be formed of film with the same thickness and material as the back sheet 38. The vapor barrier 24 should be formed of a moisture impermeable material. However, the vapor barrier 24 and the back sheet 38 may suitably be of different thicknesses. For example, it may be desired to form the vapor barrier 24 with greater thickness than the back sheet 38, since the vapor barrier 24 should remain intact after installation of the insulation assembly 10 to prevent moisture infiltration into the batt 12 from the interior of the building in which the insulation assembly 10 is installed. The vapor barrier 24 may be formed from a relatively thick film to provide increased resistance to accidental puncture during installation of drywall or other interior wall sheathing of the building wall in which the insulation assembly 10 is installed. The vapor barrier 24 preferably has a thickness of about 8 mil (0.203 mm) or less, and more preferably being in the range of 3 mil to 7 mil (0.076 mm to 0.178 mm). One preferred thickness of the vapor barrier 24 is about 4 mil (0.102 mm) and another preferred thickness is about 6 mil (0.152 mm).

Figure 2:
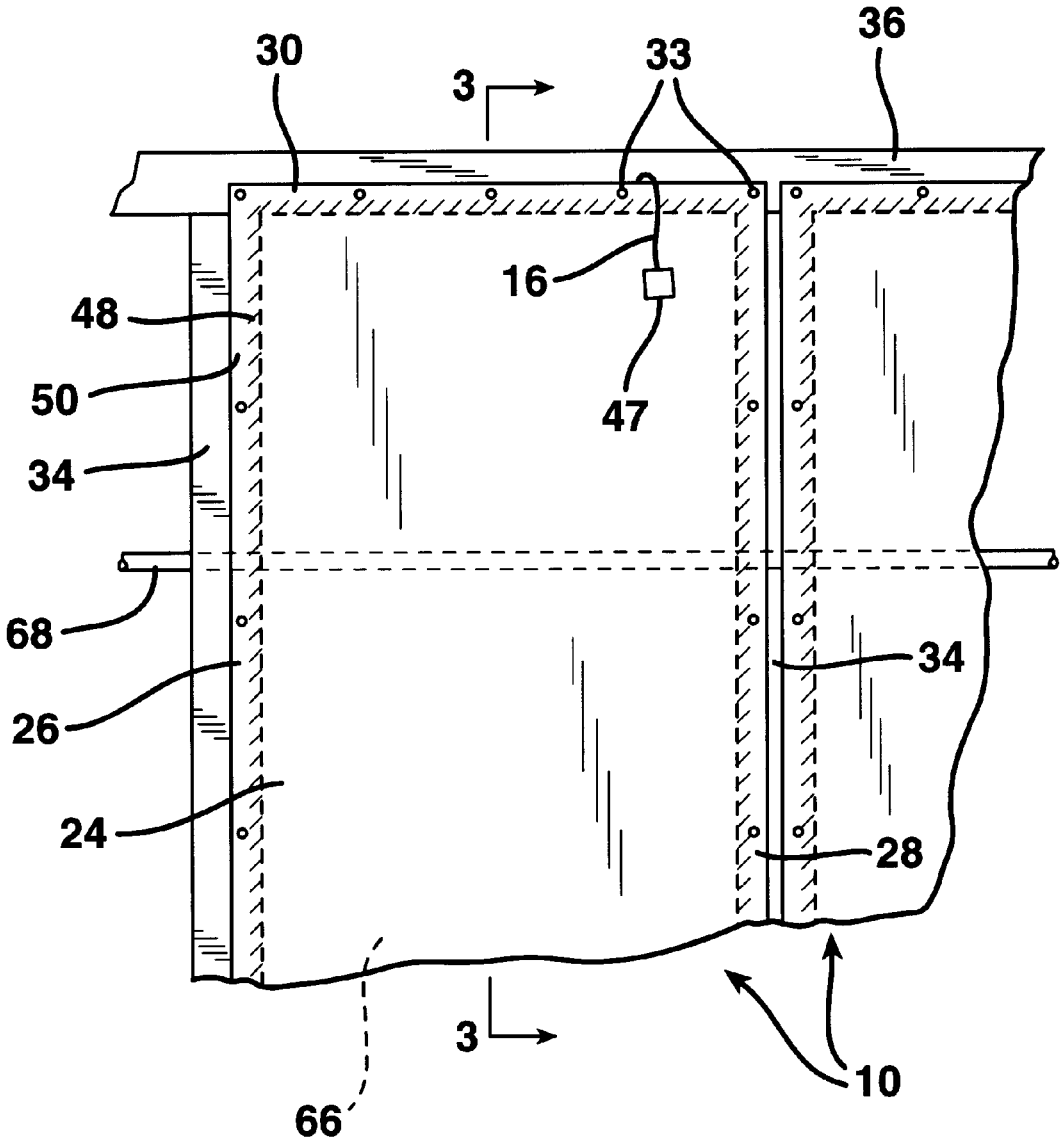
FIG. 2 is a partial elevational view of the insulation assembly installed in a wall cavity.

The back sheet 38 may suitably be provided with a structure for facilitating the controlled rupture thereof. In the embodiment illustrated in FIGS. 1 through 3C, that structure is embodied in the ripcords 16 and 18. It is anticipated that the ripcords 16 and 18 may be attached to the outer surface of the back sheet 38 with an adhesive whose strength of adhesion between the ripcords 16 and 18 and to the back sheet 38 is greater than the shear strength of the back sheet 38. Thus when one of the ripcords 16 or 18 are pulled away from the back sheet 38, a portion 46 of the back sheet 38 will tear away from the rest of the back sheet 38, remaining adhered to the ripcord 16 or 18 which was pulled. In the illustrated embodiment, only one end of each of the ripcords 16 and 18 is adhered to the back sheet 38. The rest of each of the ripcords 16 and 18 is unattached, and forms an elongated free end to facilitate extending the free end to a location which will be accessible after the insulation assembly 10 is installed, as shown in FIGS. 2 and 3A. Preferably the free end of each of the ripcords 16 and 18 is marked by a high-visibility tag 47 to facilitate locating the free ends of the ripcords 16 and 18.

The vapor barrier 24 and the back sheet 38 are hermetically sealed together along a seal area 48, shown as a cross-hatched region in FIG. 2. The seal formed at the seal area 48 joins respective inboard portions of the vertically extending flaps 26 and 28 of the vapor barrier 24 to the adjacent portions of the vertically extending flaps 40 and 42 of the back sheet 38. Similarly, the seal formed at the seal area 48 joins respective inboard portions of the horizontally extending flaps 30 and 32 of the vapor barrier 24 to the adjacent portions of the horizontally extending flaps 44 and 45 of the back sheet 38. Thus a second purpose of the flaps 26, 28, 30, and 32 of the vapor barrier 24, in addition to acting as nailing strips as described above, is to cooperate with the flaps 40, 42, 44, and 45 of the back sheet 38 to provide the seal area 48 for hermetically sealing the envelope 12 about the batt 14.

As will be appreciated, due in part to the variety of materials which may be used to form the vapor barrier 24 and the back sheet 38, a variety of suitable conventional methods are contemplated for sealing the vapor barrier 24 to the back sheet 38. Among the methods which are contemplated are heat sealing of plastic films using heated wires, rollers, or other structures, ultrasonic welding, or the use of suitable adhesives, of which one may be hot melt glue.

As may best be seen in FIG. 2, the nails 33 used to fasten the insulation assembly 10 to the studs 34, header 36 and footer of the wall in which the insulation assembly 10 is installed pass through the various vertically and horizontally extending flaps of the vapor barrier 24 and the back sheet 38 in a nail strip region 50 between the seal area 48 and the edge of the respective flaps so as not to puncture the hermetically sealed portion of the envelope 12 containing the batt 14. Suitably, the nail strip region 50 may be marked on the vapor barrier 24 to provide guidance to the installer of the insulation assembly 10, such as by coloring the nail strip region a contrasting color to the rest of the vapor barrier.

The insulation assembly 10 will preferably include a means for restricting movement between the batt 14 and the envelope 12. The means for restricting movement, or wall grip surface, retards relative movement between the mineral fiber batt and the envelope 12. This is particularly useful for preventing slumping of the batt 14 when the insulation assembly 10 is placed in a vertical position such as between the wall studs 34. Means for restricting movement may include adhesives, mechanical supports or fasteners, or the configuration or composition of the envelope 12. Where the envelope 12 is formed as a plastic or metallic film, the film may be formed as a coextruded two layer film, with an outer layer having good hermetic sealing properties and puncture resistance, and a tacky plastic inner layer which acts as a wall grip surface which contacts the batt 14 and resists relative movement therewith. The envelope 12 may also be formed with a suitably rough inner wall grip surface that resists relative movement of the batt 14 in contact therewith.

As shown in FIG. 3A, one preferred wall grip surface is an adhesive material 52 applied between the front surface 20 of the batt 14 and the vapor barrier 24. The adhesive material 52 may be applied as a layer, strip or other pattern such as dots. The adhesive material 52 may be applied to the front surface 20 of the batt 14 or may be an integral part of or applied to the film forming the vapor barrier 24, with one side of the film providing the adhesive material 52 to join to the fiber batt. The adhesive material 52 may suitably also or alternatively be applied between the back surface 22 of the batt 14 and the back sheet 38 of the envelope 12, or between the back sheet 38 and upper and side surfaces of the batt 14.

Figure 4:
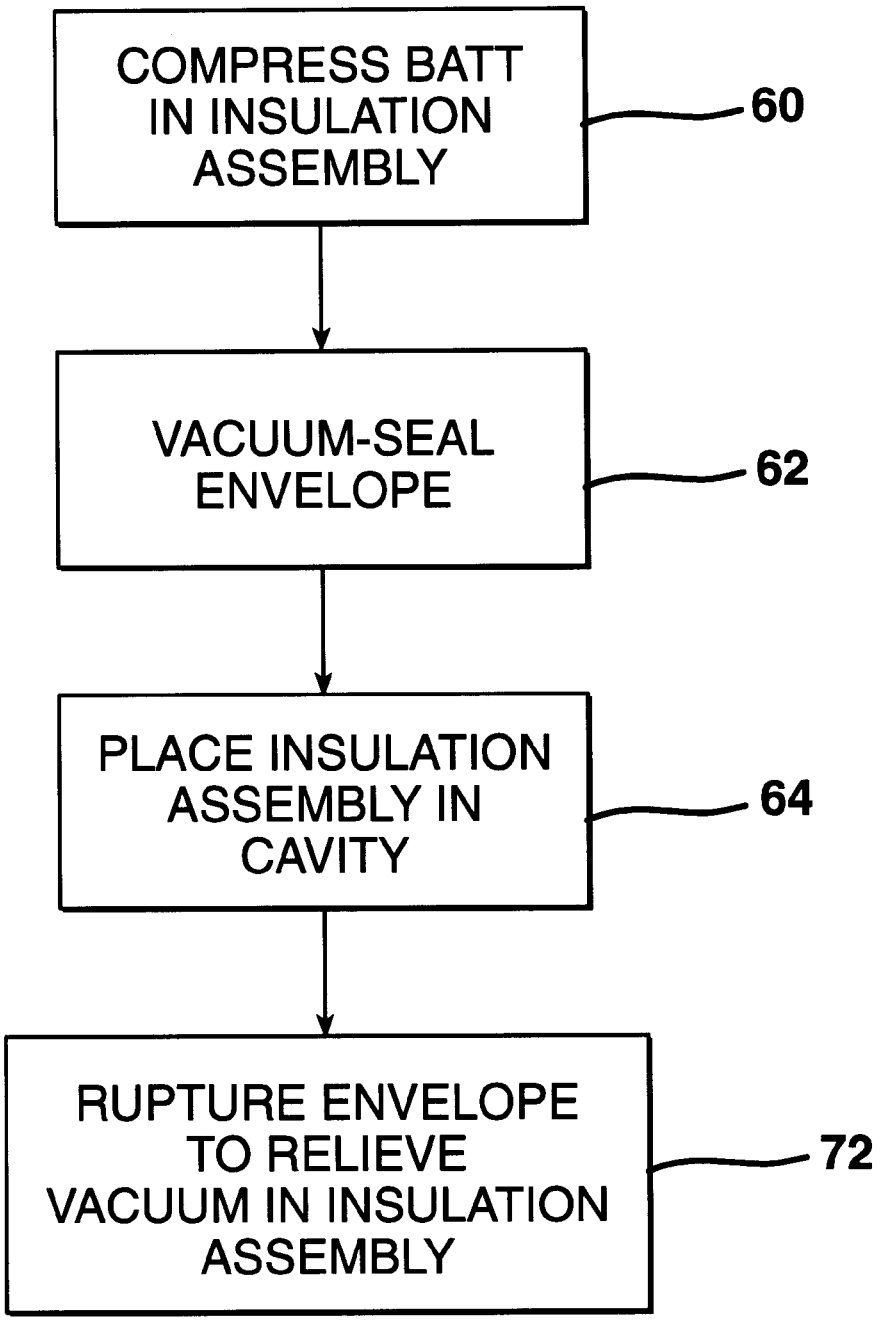
FIG. 4 is a flow chart illustrating a method according to the invention of forming and installing the insulation assembly of FIG. 1.

Referring now to FIG. 4, a method of producing and using the insulation assembly 10 according to the invention will now be described. In a first step 60, the batt 14 is compressed within the insulation assembly 10. The batt 12 is inserted between the vapor barrier 24 and the back sheet 38. If desired, portions of the vapor barrier 24 and the back sheet 38 may be sealed together in the seal area 48 prior to the batt 12 being interposed between the vapor barrier and back sheet 38.

Alternatively, the components of the insulation assembly 10 may be sequentially stacked during forming of the insulation assembly 10. For example, the vapor barrier 24 may be placed on a flat surface. An adhesive material 52 could then be sprayed onto the vapor barrier 24, and the batt 14 placed on top of the adhesive material 52 of the vapor barrier 24. The desiccant packet 15 may be placed on the batt 14. The back sheet 38 could then be draped over the desiccant packet 15 and the batt 14. Preferably, the back sheet 38 will have excess material in the central region thereof (within the seal area 48) beyond that needed simply to cover the surfaces of the batt 14 not in contact with the vapor barrier and to form the flaps 40, 42, 44, and 45. This excess material would allow the back sheet 38 and batt 14 to more easily conform to irregularly shaped cavities and around obstructions, as will be discussed below. If desired, this excess material may be formed into pleats. The ripcords 16 and 18, if used, can next be adhesively attached to the back sheet 38.

The insulation assembly 10 and the batt 14 therein are then compressed and subjected to a vacuum. It is believed that this may be accomplished in a number of suitable ways. For example, insulation assembly 10 may be placed in a vacuum chamber (not shown), and the atmospheric pressure on the inside and outside of the envelope 14 reduced equally. A mechanical press (not shown) could then be activated within the vacuum chamber to compress the insulation assembly 10 and the batt 14 therein a suitable amount. Material from the back sheet 38 that is made slack by the compression of the batt 14 can be folded into a pleat 61 as seen in FIGS. 3A and 3B. The vapor barrier 24 and the back sheet 38 could then be vacuum-sealed together according to a second step 62 of the method, described in more detail below. When the insulation assembly 10 is removed from the vacuum chamber into normal atmospheric pressure, a vacuum will exist within the sealed envelope 12 that holds the batt 12 in a compressed condition.

Another contemplated method of vacuum-sealing the insulation assembly 10 according to the steps 60 and 62 is to seal the vapor barrier 24 to the back sheet 38 along all of the seal area 48 except a small portion thereof, through which a vacuum is drawn inside the envelope 12 by connecting the volume within the envelope to a volume at a relatively lower pressure. This volume at a relatively lower pressure may, for example, be an evacuated tank or the inlet to a mechanical vacuum pump. As the pressure in the envelope decreases, external atmospheric pressure will act to compress the insulation assembly 10 and the batt 14 thereof. As the batt 14 collapses, the back sheet 38 can be manipulated to cause the excess material in the back sheet 38 to be formed into the pleats 61. After the desired amount of vacuum is drawn in the envelope 12, the remaining portion of the seal area 48 can be sealed to hermetically lock in the vacuum in the envelope 12.

Yet another way of performing the steps 60 and 62 is to seal the vapor barrier 24 to the back sheet 38 along all of the seal area 48 except a small portion thereof A mechanical press (not shown) can be used to compress the insulation assembly 10 to a desired thickness, forcing excess air out of the envelope through the unsealed portion of the seal area 48. A vacuum pump (not shown) can, if desired, be attached to draw an additional amount of atmosphere out of the envelope 12, after which the remaining portion of the seal area 48 can be sealed according to the step 62. External atmospheric pressure will act to keep the insulation assembly 10 and the batt 14 thereof compressed. However, merely compressing the envelope 12 and the batt 14 therein, and then sealing the envelope 12 will result in a vacuum being formed in the envelope. As the batt 14 begins to expand when the insulation assembly 10 is removed from the press, the volume enclosed by the envelope 12 tends to increase. The volume of the solid materials sealed within the envelope 12, e.g., the fibers of the batt 14, does not increase, and no additional air is introduced into the sealed envelope 12. As the batt 14 forces the envelope 12 to expand, a pressure differential develops between the interior and exterior of the envelope (a vacuum) which increases until the force developed by this pressure differential matches the force the batt 14 exerts in trying to expand. Thus the batt 14 may be vacuum-sealed in the envelope 12 of the insulation assembly 10 according to the first two steps 60 and 62 of the method of this invention without the use of a vacuum pump or similar device.

Prior art insulation products are typically packaged in high compression in order to ship more insulation in a defined volume, such as a truck. At the point of installation the insulation product is unpackaged and the product expands or recovers. The thickness to which the insulation product recovers is referred to as the recovered thickness. A specific thickness of insulating material is required to perform to a specified R-value.

The ability of an insulation product to recover depends upon both the uncompressed product density and the density to which the product is compressed. Wool insulating material can be generally classified into three broad categories: light, medium and heavy density. Light density insulation products are those with a product density within the range of 0.3 pcf to 0.6 pcf (4.8 kg/m$^3$ to 9.6 kg/m$^3$). Medium density insulating materials are those with a product density of from 0.6 pcf to 0.9 pcf (9.6 kg/m$^3$ to 14.4 kg/m$^3$). Heavy density wool insulating materials are those higher than 1.0 pcf (16 kg/m$^3$).

The compressed density is the density to which the wool batt can be compressed for shipping while still maintaining a satisfactory recovery. If a product is compressed to too high a density, a substantial portion of the glass fibers may break. As a result, the product will not recover to a satisfactory thickness. For light density insulation products of straight fibers, the maximum practical compressed density is from about 3 pcf to about 6 pcf (48 kg/m$^3$ to 96 kg/m$^3$), depending on the product density.

Light density wool insulating materials of the preferred embodiment of the invention, that is, long, irregularly shaped fibers in a batt without binders, produce dramatically improved recovery properties. This increase in recovery ability is due to the unique shape and properties of the irregularly-shaped fibers. Due to the binderless nature of the irregularly-shaped glass fibers of the preferred embodiment, one would expect them to slide upon compression, as do the binderless straight fibers of the prior art. However, the irregularly-shaped fibers cannot slide very far because the irregular shape catches on neighboring fibers, thereby preventing significant movement. Further, there is no binder placing stress on the fibers near the intersections. Rather, the irregularly-shaped fibers of the present invention twist and bend in order to relieve stress. Thus, the fibers' positions are maintained and any available energy for recovery is stored in the fiber. This stored energy is released when the compression is removed and the fibers return to their recovered position.

The term recovery ratio in the present invention is defined as the ratio of recovered density to compressed density, after an insulation product is compressed to the compressed density, unpackaged, and allowed to recover to the recovered density, according to ASTM C167-90. For example, an insulation product compressed to a density of 6 pcf (96 kg/m$^3$) which recovers to 0.5 pcf (8 kg/m$^3$) has a recovery ratio of 12:1. Light density wool batts of the preferred embodiment of the present invention may be compressed to a compressed density within the range of about 6 pcf to about 18 pcf (96 kg/m$^3$ to 288 kg/m$^3$) and recover to a recovered density of within the range of about 0.3 pcf to about 0.6 pcf (4.8 kg/m$^3$ to 9.6 kg/m$^3$). This is a recovery ratio within the range of from 12:1 to about 50:1. Preferably, insulation products of the invention will be compressed to a compressed density within the range of from about 9 pcf to about 18 pcf (144 kg/m$^3$ to 288 kg/m$^3$) and recover to a recovered density within the range of from about 0.3 pcf to about 0.6 pcf (4.8 kg/m$^3$ to 9.6 kg/m$^3$). Most preferably, the light density insulation products are compressed to a density of within the range of from about 9 pcf to about 15 pcf (144 kg/m$^3$ to 240 kg/m$^3$) and recover to a recovered density of within the range of from about 0.3 pcf to about 0.5 pcf (4.8 kg/m$^3$ to 8 kg/m$^3$).

The effect of this dramatic increase in the amount of compression that can be applied to light density insulation products of the preferred embodiment of the present invention while still maintaining a satisfactory recovered density is significant. For standard R19 insulation products, compressed density can be increased from around 4 pcf (64 kg/m$^3$) to about 12 pcf (192 kg/m$^3$) by employing irregularly-shaped glass fibers of the present invention. This translates to around 3 times as much insulating material that can be shipped in the same volume shipping container, such as a truck or rail car. The potential savings in shipping cost are enormous. Additionally, the more highly compressed insulation products provide benefits in storage and handling for warehousing, retailing and installing the product.

The degree of vacuum required to maintain the compression described above has been estimated as follows: To compress the insulation batt 12 of the preferred embodiment, having long, irregularly shaped, binderless glass fibers, to a compressed density of 3 pcf (48 kg/m$^3$) has been estimated to require a vacuum in the envelope 12 of about 1.5 pounds per square inch (psi) (10.35 kilopascals (kPa)) less than the surrounding atmospheric pressure. A compressed density of 10 pcf (160 kg/m$^3$) has been estimated to require a vacuum of about 10.3 psi (71.07 kPa) less than the surrounding atmosphere. A compressed density of 12 pcf (192 kg/m$^3$) has been estimated to require a vacuum of about 14.69 psi (101.36 kPa) less than the surrounding atmosphere.

Typically, the light density fiber insulation products have been rolled up to compress the fibers to the degree discussed above, and then placed into a plastic overpack or sleeve to hold the insulation product in this compressed state. The vacuum packaged insulation assembly 10 of the present invention does not need an overpack container to maintain the insulation assembly 10 in a compressed condition unless a very high degree of compression is desired, i.e., a degree of compression requiring a force of compression greater than that which can be supplied by atmospheric pressure. If the vacuum in the envelope 12 maintains the insulation assembly 10 in the desired compressed condition during shipping and handling, no overpack would be required. It is anticipated that the compressed vacuum packaged insulation assemblies 10 can be formed flat and handled in a manner similar to sheets of thin plywood, and shipped without an overpack. If desired to keep a bundle of the insulation assemblies together, a lightweight overpack may be used at less cost than the heavyweight overpack needed to keep conventional insulation assemblies in compression. Of course, if desired, the insulation assembly 10 of the present invention can be formed into a roll during manufacture. Indeed, rolling the insulation assembly 10 to compress the batt 12, instead of using a press as described above for some methods of performing the step 60 is specifically contemplated.

If a degree of compression in excess of that which can be supplied by atmospheric pressure is desired, the insulation assembly 10 of the present invention can be compressed to the desired degree of compression, the envelope 12 vacuum-sealed, and the insulation assembly 10 placed in an overpack designed to maintain the insulation assembly in the desired highly compressed condition for transportation to the point of usage. When removed from the overpack, the insulation assembly 10 will recover slightly, but still remain in a compressed state for ease of handling and installation as long as the envelope 12 remains intact.

At the job site, the installer takes the vacuum packed insulation assembly 10 and places the insulation assembly in a selected wall cavity according to a third step 64 (FIG. 4) of the method of the invention. In the vacuum-sealed state, the insulation assembly 10 is expected to be easier to handle than might be expected given the preferred easily conformable nature of the batt 14 contained therein when the batt 14 is in an expanded state (recovered). It is expected that the vacuum packaged insulation assembly 10, while not completely rigid in the manner of a solid wooden board of equal thickness, will be sufficiently rigid that the insulation assembly 10 will be easily installed in a vertically extending wall cavity. While not wishing to be bound by any theory, it is expected that by maintaining the batt 14 under compression by means of the vacuum in the envelope 12, the fibers of the batt 14 will be less free to shift relative to one another. Reducing the ability of the fibers of the batt 14 to move relative to one another increases the rigidity of the insulation assembly 10, and facilitates the handling thereof.

Figure 3C:
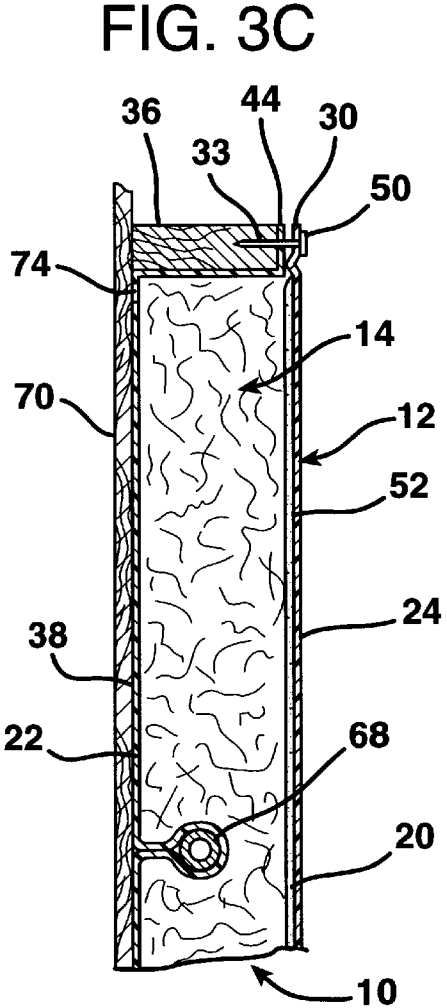
FIG. 3C is a view taken along the line 3—3 of FIG. 2 showing the insulation assembly expanded around an obstructing pipe to substantially fill the wall cavity.
Figure 3B:
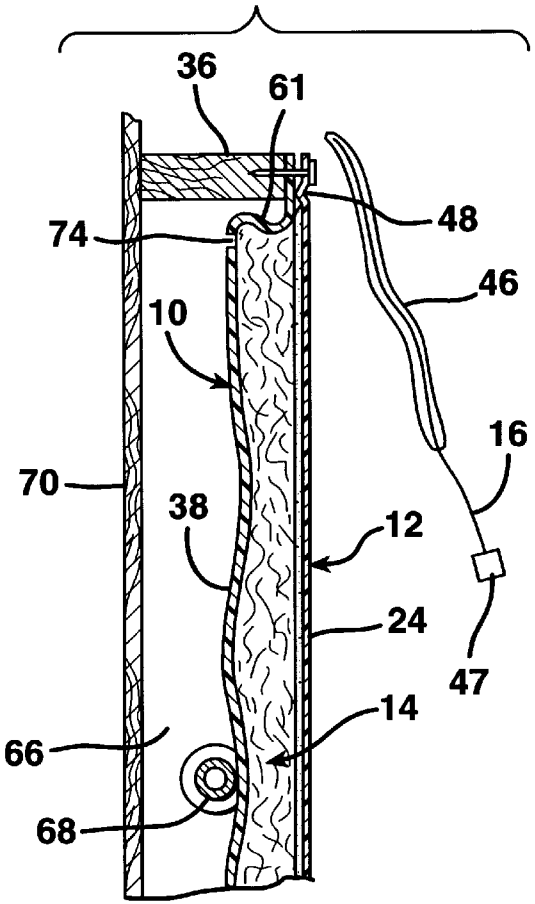
FIG. 3B is a view taken along the line 3—3 of FIG. 2 showing the insulation assembly after rupturing of the envelope thereof, before the assembly fully expands.
Figure 3A:
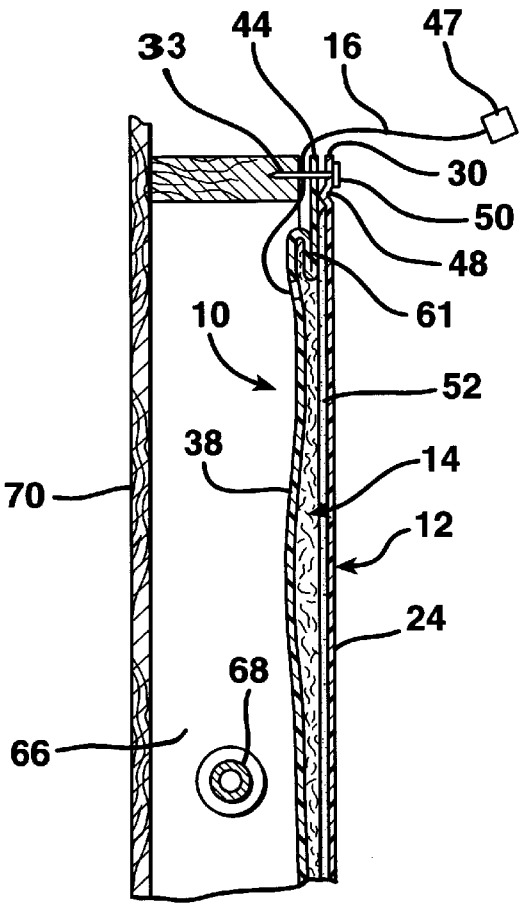
FIG. 3A is a view taken along the line 3—3 of FIG. 2 showing the insulation assembly prior to rupturing of the envelope thereof.

More specifically, as best seen in FIGS. 2 through 3C, the installer identifies a cavity 66 between a pair of the studs 34, the header 36, and the footer of the wall of the building in which the insulation assembly 10 is being installed. Typically, the cavity 66 may be partially obstructed by structures such as a pipe 68, wiring, or electrical boxes and the like, extending through or into the cavity 66. The installer then attaches the insulation assembly with the back sheet 38 most adjacent the outer wall sheath 70, and the vapor barrier 24 facing the interior of the building. The insulation assembly 10 may be attached to the wall in any suitable manner. For example, an adhesive (not shown) may be applied to the studs 34, the header 36, and the footer of the wall, and the flaps 40, 42, 44, and 45 of the back sheet 38 pressed against the adhesive to hold the insulation assembly 10 in place in the cavity. More preferably, staples or nails 33 are driven through the nail strip region 50 of the insulation assembly 10 to attach the insulation assembly 10 to the wall. The vapor barrier 24 extends across a portion of the interior surfaces of the studs 34, header 36, and footer of the wall, thus acting as a barrier to moist air in the building from penetrating into the wall cavity, in the manner of conventional vapor barriers. The batt 14, contained in the envelope 12, extends into the wall cavity in accordance with the third step 64. During fastening, the installer will preferably lead the free end of one or both of the ripcords 16 and 18 to pass between the wall structure (such as the header 36 as shown in FIG. 3A) and the nailing region to leave the tag 47 thereof exposed to be grasped even after the vapor barrier 24 is secured.

According to a fourth step 72 of the method of the invention, the installer ruptures the envelope 12, relieving the vacuum in the insulation assembly 10. It is believed that only a relatively small opening through the envelope 12 will be needed to adequately relieve the vacuum in the insulation assembly 10, e.g., a hole having a diameter on the order of a few sixteenths of an inch or a few millimeters should be sufficient. Of course, a larger opening or multiple openings would relieve the vacuum more quickly, and would be less likely to be obstructed during the subsequent expansion of the insulation assembly 10. As described above, the ripcords 16 and 18 are preferably lead to hang free out from under the vapor barrier 24 while the insulation assembly 10 is being attached to the wall. As shown in FIGS. 1 and 3C, the ripcord 16 may be pulled from the free end to rupture the envelope 12 by removing the attached portion 46 of the back sheet 38. This creates an opening 74 through the back sheet 38 while leaving the vapor barrier 24 intact. The ripcord 18 is similarly pulled to form a second rupture of the envelope 12 (not shown). As will be further discussed below with respect to FIGS. 5 through 7, any suitable method, however, may be used to rupture the envelope 12. Indeed, if desired, the vapor barrier may be punctured to rupture the envelope 12. However, it will normally be desirable to subsequently patch any punctures in the vapor barrier to prevent moisture infiltration into the batt 14 from the interior of the building, which would decrease the efficiency of the insulation assembly 10.

After the envelope 12 is ruptured, the batt 14 begins to recover, expanding away from the vapor barrier 24 as the air in the cavity 66 infiltrates into the envelope 12 through the opening 74, as seen in FIG. 3B. The extra material in the back sheet 38, which was preferably formed into the pleats 61, accommodates the expansion of the batt 14.

As the batt 14 expands, an obstruction such as the pipe 68 may be encountered. Due to the conformable nature of the long binderless fibers of the preferred embodiment of the batt 14, the insulation assembly 10 expands to substantially fill the cavity 66, conforming about the outer surface of the pipe 68, as shown in FIG. 3C.

Despite the conformable nature of the insulation assembly 10, the insulation assembly 10 should be chosen by the installer to generally match the size and depth of the cavity. For example, an insulation assembly 10 that is 6 inches (15 cm) thick when fully recovered should not be chosen to completely fill, by itself, a cavity which is 10 inches (25 cm) deep. Similarly, an insulation assembly 10 which is 8 feet (2½ meters) long should not be chosen to completely fill, by itself, a cavity which is 10 feet (3 meters) long. Furthermore, it is desirable that the insulation assembly 10 is chosen so that, generally, the batt 14 thereof can nearly fully recover to the densities described above, in order to achieve the desired insulating properties at the least cost. Accordingly, it is anticipated that the insulation assembly 10 may be provided in a variety of shapes and sizes to generally approximate, when recovered, common cavity sizes and shapes.

In some situations, it may be desired to cut the insulation assembly 10 to conform to oddly shaped cavities for which no generally similarly shaped insulation assembly 10 is available. Of course, the installer could rupture the envelope 12, let the insulation assembly 10 recover, and then cut and install the insulation in a manner similar to standard insulation. However, preferably, the installer will attach as much of the insulation assembly 10 to the wall as is comfortably possible without cutting the envelope 12. The installer can then cut the insulation assembly 10 to shape, and finish fastening the remainder of the insulation assembly 10 to the wall as the insulation assembly 10 recovers.

Figure 5:
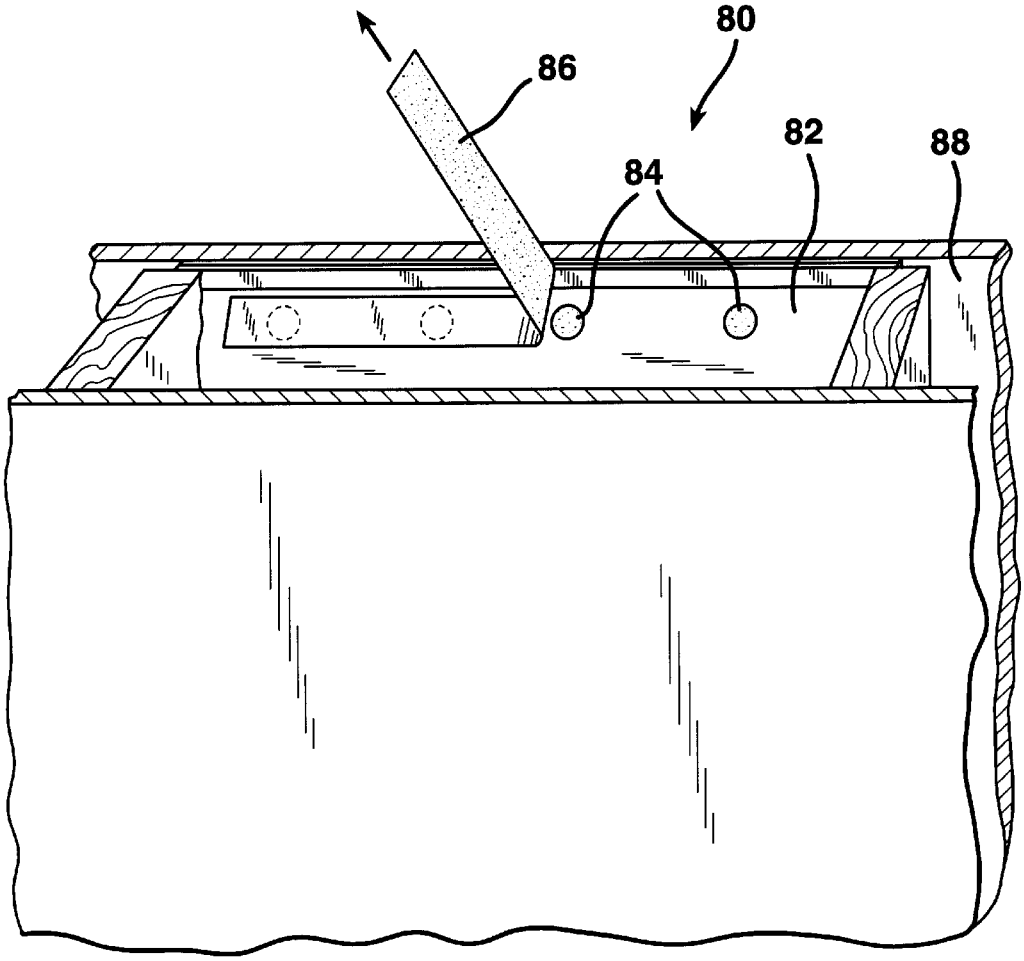
FIG. 5 is a partial perspective view of an alternate embodiment of the insulation assembly of the invention.

FIG. 5 illustrates an alternate embodiment of an insulation assembly according to the invention, indicated generally at 80. The insulation assembly 80 is constructed in a manner similar to the insulation assembly 10 described above. However, the insulation assembly 80 is not provided with ripcords similar to the ripcords 16 and 18 that tear the back sheet 38 of the insulation assembly 10. Instead, the insulation assembly 80 is provided with a back sheet 82 having a plurality of openings 84 formed therethrough. The openings 84 are hermetically sealed by an adhesive tape 86. It should be noted that although a plurality of the openings 84 are shown, it is contemplated that a single suitably sized opening 84 may be provided. It is also contemplated that each of the openings 84 may be closed by respective one of a plurality of adhesive tapes 86. The insulation assembly 80 is installed in an appropriate cavity. One such cavity is the wall cavity illustrated in FIG. 5 in which the installer has access to the tape 86 following installation of the insulation assembly 80 therein, even after an inner wall sheath (such as gypsum board 88) has been installed to close the cavity. The installer then removes the tape 86 to rupture the envelope of the insulation assembly 80 by unsealing the openings 84. This allows the insulation assembly 80 to expand in the cavity. It is also contemplated that the tape 86 may be a non-adhesive tape. A non-adhesive tape 86 could be held in place to close the openings 84 by any suitable means, such as an adhesive (not shown) about the openings 84 which adheres to the tape 86, but adheres even more strongly to the back sheet 82. When removed, such a non-adhesive tape 86 would not stick to other portions of the insulation assembly 80. It is contemplated that a non-adhesive tape 86 could be formed with an extended free end. Such a free end could be lead out from under the vapor barrier of the insulation assembly 80 in a manner similar to the free ends of the ripcords 16 and 18 of the insulation assembly 10 as illustrated in FIGS. 2 and 3A. The non-adhesive tape 86 could then be pulled by the installer from the interior of the wall to uncover the openings 84 in the back sheet 82 of the insulation assembly 80. This is possible because the tape 86 would not adhere to the seal portion or flaps or other surfaces of the insulation assembly 80 or the wall as the tape 86 is pulled along those surfaces.

The insulation assemblies 10 and 80 may be especially useful in remodeling and retrofitting older buildings with uninsulated walls. It is expected that an installer could gain access to cavities in existing walls through any convenient manner, such as by removing a portion of the outer wall sheath 70, or by cutting a hole in the header 36 of the wall. The relatively thin vacuum-sealed insulation assembly 10 or 80 could then be lowered into the wall cavity 66, fitting between the walls of the cavity 66 and such obstructions as nails sticking through the outer wall sheath 70 and plumbing and electrical assemblies such as the pipe 68 illustrated in FIGS. 2 through 3C. The installer may wish to use a tool (not shown) such as a long flexible rod to assist in guiding the lower end of the insulation assembly 10 or 80 into the wall cavity 66. When the insulation assembly 10 or 80 is in position in the cavity 66, the installer can rupture the associated back sheet of the insulation assembly 10 or 80 to cause the batt therein to expand against the surfaces of the cavity, holding the insulation assembly 10 or 80 in place. The expanded batt likewise will press the vapor barrier of the insulation assembly 10 or 80 against the inner wall sheath surface of the cavity 66.

Figure 6:
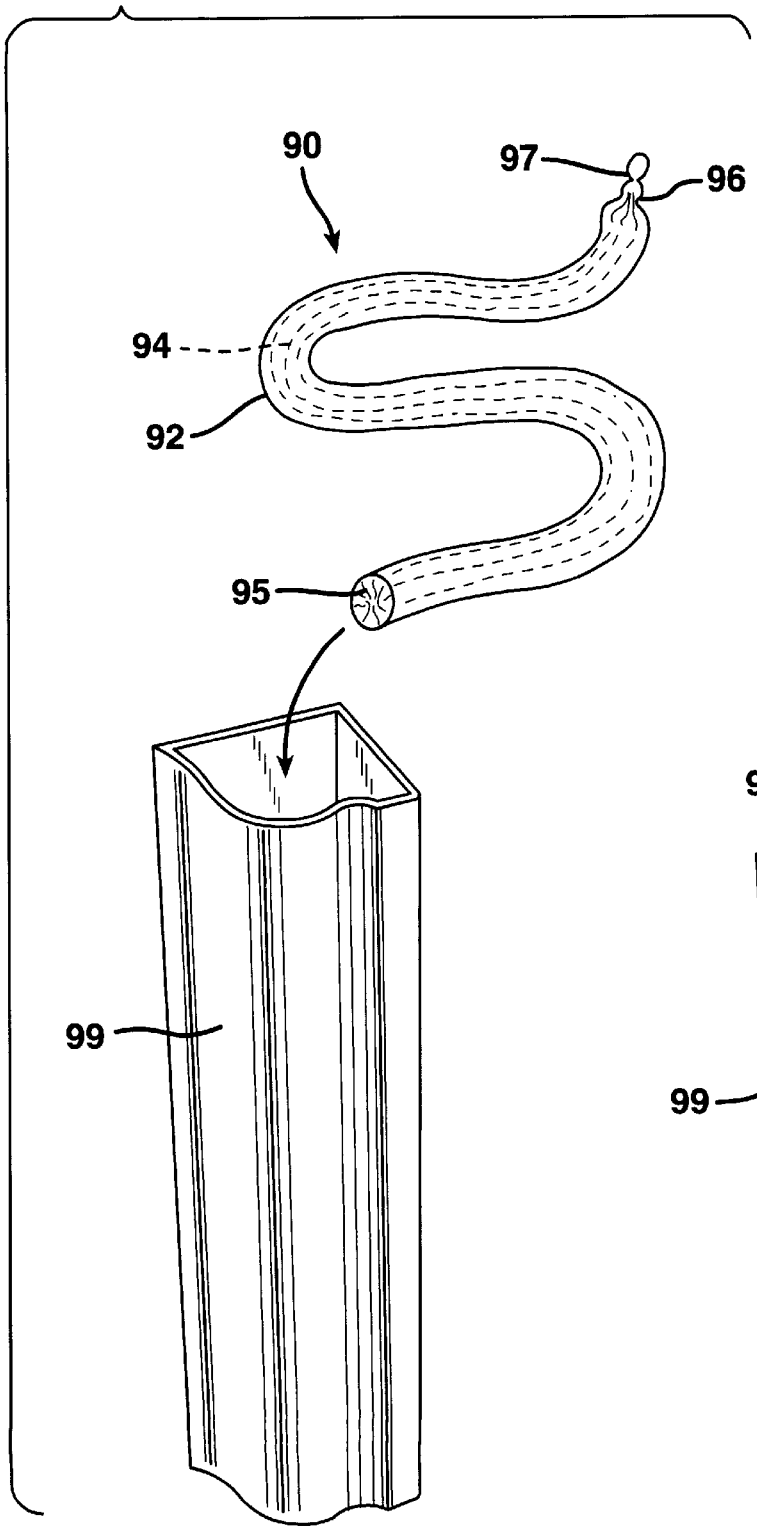
FIG. 6 is a perspective view of another alternate embodiment of the insulation assembly of the invention that is adapted to be inserted into a hollow member.
Figure 7:
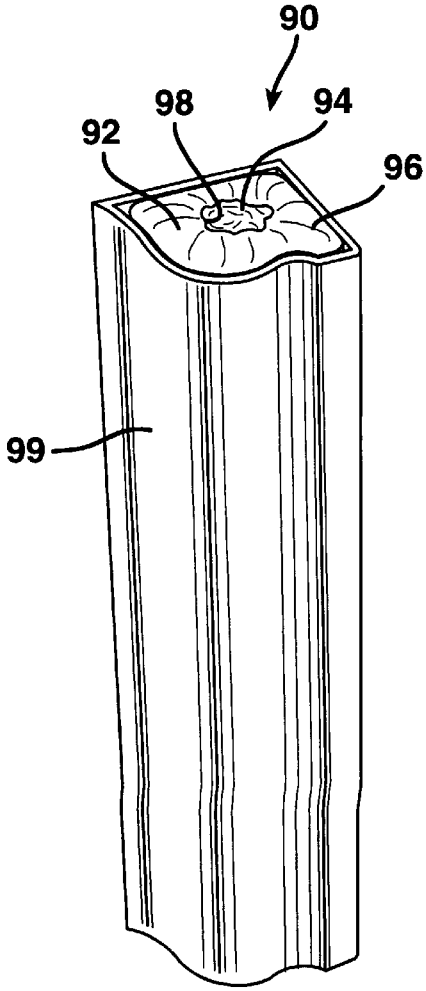
FIG. 7 illustrates the insulation assembly shown in FIG. 6 with the insulation assembly expanded to conform to the interior of the hollow member.

Another embodiment an insulation assembly of the invention, indicated generally at 90, is illustrated in FIGS. 6 and 7. The insulation assembly 90 includes an envelope 92, which is vacuum-sealed about an insulation batt 94. The envelope 92 is formed of any suitable material, such as those described for use for making the envelope 12 discussed above. Similarly, the batt 94 can be formed of any suitable material, and is preferably formed of the irregularly shaped, long, binderless glass fiber material described above with respect to the batt 14 discussed above.

The batt 94 is formed into an elongate cylinder, or other suitable shape, and vacuum sealed in the envelope 92 in a radially compressed state. The envelope 92 is preferably formed from a single tubular membrane. The illustrated embodiment of the envelope 92 is permanently sealed at a first end 95. A second end 96 of the envelope 92 sealed in a flattened portion of the envelope 92 extending beyond the batt 94.

Optionally, a notch 97 is formed in an edge of the envelope 92 outside of the vacuum-sealed portion of the envelope 92. The notch 97 provides a convenient stress-intensifying location at which the installer can tear the envelope 92 with his or her hands. The notch 97 is located adjacent the hermetic seal at the second end 96 of the envelope such that a tear in the envelope 92 which is begun at the notch 97 would naturally propagate through the hermetic seal, rupturing the envelope 92. The vacuum in the envelope 92 would then be relieved through an opening 98 thus formed in the envelope 92.

The insulation assembly 90 is especially adapted to be installed in elongate cavities, such as the cavity which is the interior of the tubular extruded structure 99 illustrated in FIGS. 6 and 7. The structure 99 could be, for example, a portion of a metallic window frame prior to assembly. The insulation assembly 90 is easily inserted, in the manner of a small cord, into the interior of the structure 99 while the insulation assembly 90 is vacuum-sealed. When the insulation assembly 90 is in place, the insulation assembly 90 is ruptured by tearing off a portion of the second end 96 of the envelope 92 to form the opening 98. Alternatively, a suitable object may be used to puncture the second end 96 to form the opening 98. The first end 95 of the insulation assembly 90 may also be thus punctured. With the vacuum in the envelope 92 relieved, the batt 14 recovers to substantially fill the interior cavity of the structure 99.

While the envelope of the present invention, such as the envelopes 12 and 92, has been described as being hermetically sealed and formed of gas impermeable materials, another embodiment of the invention (not shown) is contemplated in which the envelope resists only rapid gas intrusion until ruptured. For example, the envelope may be formed of a material which is not completely gas impermeable, or may have a few small holes. It is contemplated that in such an embodiment, the insulation assembly may be provided to the job site under mechanical compression, such as that provided by an overpack. Upon removal from compression, the insulation assembly remains vacuum-sealed, according to the invention, for a period of time ample to easily install the insulation assembly in a desired cavity before substantial recovery of the insulation assembly occurs. For example, it is expected that the insulation assembly of this embodiment could be designed to sufficiently retard air infiltration that the insulation assembly retains a vacuum for an extended period of time (for example, greater than about two hours) before sufficient air infiltration occurs to permit the insulation assembly to significantly recover in thickness (for example, to recover to more than about 25% of fully recovered thickness).

The principle and mode of operation of this invention have been described in its preferred embodiments. However, it should be noted that this invention may be practiced otherwise than as specifically illustrated and described without departing from its scope.

What is claimed is:

1. A vacuum packaged insulation assembly comprising:

a compressed insulation material comprising a mineral fiber batt;

an intact envelope vacuum-sealed about said insulation material whereby said insulation material is held in compression by the vacuum in said envelope, said envelope defining a hole therethrough; and a structure fixed to said envelope for selectively rupturing said envelope to discharge the vacuum and thereby enable said insulation material to expand, said structure comprising a portion of said envelope in the form of a strip of non-adhesive tape sealing engaging adhesive material disposed on said envelope about said hole so as to seal said hole.

2. The assembly as claimed in claim 1 wherein said compressed insulation material comprises a batt of binderless glass fiber material of substantially long fibers.

3. The assembly as claimed in claim 1 wherein said envelope is comprised of a vapor barrier and a back sheet hermetically sealed together, said vapor barrier defining a vapor barrier side of said envelope, said envelope being provided with a flap for attaching said envelope to a second structure having a cavity defined therein, said structure fixed to said envelope being fixed to said back sheet and having an elongate free portion extendable from a point of attachment to said back sheet past said flap to said vapor barrier side of said envelope.

4. The assembly as claimed in claim 1 wherein said envelope is comprised of a vapor barrier and a back sheet hermetically sealed together about said compressed insulation material, said vapor barrier defining a vapor barrier side of said envelope said back sheet defining said hole through said envelope, and wherein said tape has an elongate free portion extendable from a point of attachment about said hole through said back sheet to said vapor barrier side of said envelope.

5. The assembly as claimed in claim 1 wherein said strip of tape includes an elongate free portion having a high-visibility tag fixed thereto.

* * * * *